US006972073B2

(12) United States Patent
Autio

(10) Patent No.: US 6,972,073 B2
(45) **Date of Patent: *Dec. 6, 2005**

(54) METHOD FOR CONVEYING AND GUIDING A LEAD-IN STRIP OF A WEB IN A PAPER MACHINE

(75) Inventor: Jukka Autio, Karstula (FI)

(73) Assignee: Metso Paper, Inc., Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/348,726

(22) Filed: Jan. 22, 2003

(65) Prior Publication Data

US 2004/0007341 A1 Jan. 15, 2004

Related U.S. Application Data

(62) Division of application No. 09/696,212, filed on Oct. 25, 2000, now Pat. No. 6,533,899, which is a division of application No. 09/408,962, filed on Sep. 29, 1999, now Pat. No. 6,290,817.

(30) Foreign Application Priority Data

Sep. 29, 1998 (FI) ..... 982087

(51) Int. Cl.[7] ..... D21E 1/36

(52) U.S. Cl. ..... 162/193; 162/289; 162/363; 162/202; 162/207; 162/255; 226/91; 226/95; 226/97; 34/120; 34/113; 34/116; 34/117

(58) Field of Search ..... 162/193, 289, 162/363, 202, 207, 255, 286; 226/91, 95, 226/97; 34/120, 113, 116, 117

(56) References Cited

U.S. PATENT DOCUMENTS 4,815,220 A * 3/1989 Wedel ..... 34/120
6,290,817 B1 * 9/2001 Autio ..... 162/289

FOREIGN PATENT DOCUMENTS

| | | |
|---|---|---|
| JP | 44054 | 2/1988 |
| JP | 115349 | 5/1990 |
| JP | 266531 | 10/1990 |
| JP | 401015 | 12/1990 |

* cited by examiner

*Primary Examiner*—Mark Halpern
(74) *Attorney, Agent, or Firm*—Steinberg & Raskin, P.C.

(57) ABSTRACT

The invention relates to a method for conveying and guiding a lead-in strip in a paper machine, in which method a lead-in strip is directed over a run of a conveyor in the paper machine and a longitudinal vacuum effect is produced across the run of the conveyor in the direction of moment of the run of the conveyor.

5 Claims, 11 Drawing Sheets

FIG. 3A
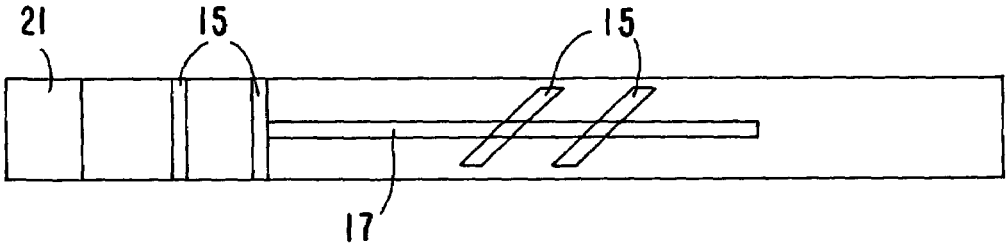
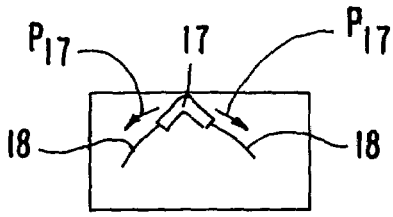
FIG. 3B
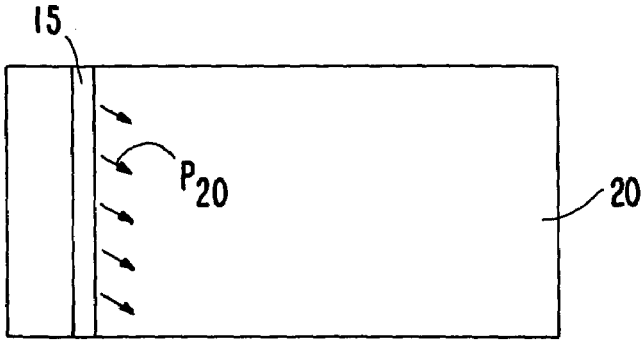
FIG. 4

METHOD FOR CONVEYING AND GUIDING A LEAD-IN STRIP OF A WEB IN A PAPER MACHINE

CROSS-REFERENCE TO RELATED APPLICATION

This application is a divisional application of U.S. patent application Ser. No. 09/696,212 filed Oct. 25, 2000, now U.S. Pat. No. 6,533,899, which in turn is a divisional application of U.S. patent application Ser. No. 09/408,962 filed Sep. 29, 1999, now U.S. Pat. No. 6,290,817, which claims priority Finnish Patent Application No. 982087 filed Sep. 29, 1998.

FIELD OF THE INVENTION

The present invention relates to devices and methods for conveying and guiding lead-in strips of webs in paper machines which utilize means for producing vacuum effects to cause the lead-in strips to adhere to and be kept in contact with runs of conveyor belts of the paper machines.

BACKGROUND OF THE INVENTION

As known in prior art, when a paper machine is started or after a web break, a tail of the web is passed through the paper machine by cutting from the web a narrow lead-in strip, which is guided manually through the machine by using air jets as well as different guide plates and threading devices. Continuously increasing running speeds of paper machines have caused increasing problems in threading of the web and thus new types of arrangements have been needed in order to accomplish threading of the web.

With respect to the prior art relating to the invention, reference is made to U.S. Pat. No. 3,355,349, which discloses a belt conveyor intended for transfer of a lead-in strip to a calender or to a reel-up, or a belt conveyor disposed before a calender. This known belt conveyor comprises two reversing rolls and a closed and air pervious belt loop disposed therebetween and having an upper run which is subjected to a vacuum. This vacuum is produced by means of a suction box which is placed inside the belt loop and which creates a vacuum effect on the upper run of the belt to keep the lead-in strip in contact with the conveyor belt. A drawback in this known device has been that the device which is based on a suction box is rather complex and heavy in structure and it includes a large number of wearing parts and takes much space. This known device lacks the possibility of profiling in a longitudinal direction, and in terms of servicing it is not advantageous. In this arrangement known from prior art, there is a high vacuum on the entire run with the result that there is created heavy friction, and thus large motors are required for conveying the conveyor belt and the web. The purpose of the present invention is to develop further the above-mentioned conveyor device so that the above-noted drawbacks may be avoided.

With respect to the prior art relating to the invention, reference is also made to FI Patent 69145, which discloses a device for conveying and guiding a lead-in strip of a web in a paper machine. This prior-art device comprises a conveyor belt arranged around two or more reversing rolls, which belt is pervious to air and has devices arranged within its loop for producing a vacuum effect on the run of the conveying belt on which the lead-in strip is conveyed, the lead-in strip being caused to adhere to and be held in contact with the run of the conveyor belt by means of the vacuum effect. On the conveying run of the conveyor belt, inside its loop, there are provided air blow means which include guide plates extending substantially parallel to the plane of the conveyor belt and the conveying run, in connection with which plates a dynamic vacuum effect can be produced by means of air blowings, the lead-in strip being caused to adhere to and be kept in contact with the conveying run of the conveyor belt by means of the vacuum effect. This known arrangement requires an external source of air and a rather large amount of air. This known device suffers from the problem that the air blow means placed one after the other in the running direction of the belt produce a wavelike vacuum curve, which changes from a negative pressure into a positive pressure just before the next air blow means. A problem in this kind of device is that it may cause the web to form bights at the areas with a positive pressure. The purpose of the invention is to develop further this known conveyor device such that the drawbacks described above may be avoided.

OBJECTS AND SUMMARY OF THE INVENTION

It is an object of the present invention to provide new and improved device for conveying and guiding a lead-in strip of a web which does not take up much space.

It is another object of the present invention to provide a new and improved device for conveying and guiding a lead-in strip of a web which is readily serviceable.

It is a further object of the present invention to provide a new and improved device for conveying and guiding a lead-in strip of a web which does not require a large amount of air thereby allowing the amount of air used for producing a vacuum effect to be minimized.

It is another object of the present invention to provide a new and improved device for conveying and guiding a lead-in strip of a web which can be regulated in a longitudinal direction.

In order to achieve these objects and others, a device for conveying and guiding a lead-in strip according to the invention includes a conveyor formed of an air permeable material, the conveyor having a run with opposed faces on respective sides, the lead-in strip being conveyed on a first face on a first side of the run, and a foil rib located on a second side of the run of the conveyor, the foil rib comprising a foil head for producing a vacuum effect on an outlet side of the foil head in the direction of movement of the run.

More specifically, on the conveying run of the conveyor belt in accordance with invention, inside the loop of the run, foil ribs are fitted whose heads are in contact with or in the immediate vicinity of the conveyor belt or wire or equivalent, which foil ribs cause a vacuum level to be produced on the outlet face. In connection with the foil ribs, blow nozzles are provided for blowing in the direction of the foil such that a vacuum area is achieved over the distance between two foil heads. The foil head provides a vacuum area without an external source of air as the head guides air away from its outlet side.

In accordance with another embodiment of the invention, the conveyor belt/band/wire is rotated by an electric motor by means of a cogged belt or by a compressed-air motor from the end of a roll. The advantages of the cogged belt drive include non-slipping acceleration and deceleration, an even driving speed and easy controllability. Air blown through the compressed-air motor or obtained from a separate compressed-air source is passed into foil ribs which are placed under the conveyor belt and by means of which a vacuum can be produced under the wire. The angle of the foil can be regulated, thereby allowing the vacuum level of the foil to be regulated. If a desired vacuum level is not achieved by the action of the foil ribs only, it is possible to utilize the Coanda effect which is provided by means of compressed air or from residual air of the compressed-air motor by blowing air through a nozzle fitted in connection with the foil rib along the face of the foil rib. The blow nozzle may be divided into two or more sectors in the cross direction in order to regulate the cross direction blow capacity.

In accordance with an additional feature of the invention, the foil ribs are provided with curved guide faces which further guide the air flow such that the vacuum over the entire length between the foil ribs will remain as desired, and a harmful pressure pulse of positive pressure will not be generated.

The arrangement accomplished by means of a compressed-air motor in accordance with the invention provides its vacuum by itself, and no external source of air is needed. Thus, the consumption of air can be minimized. Controllability is provided by regulating the angle of the foil or the amount of blown air. The distance between the foil ribs is chosen such that a desired vacuum effect can be maintained.

In accordance with one embodiment, a high vacuum is used in the first foil nozzle, and when the conveyor belt is above the web, a vacuum is also needed for other nozzles. In certain applications, subsequent nozzles are not always needed, for example, in applications in which the transfer distance is not long and the web is situated above the conveyor belt. The vacuum level is regulated by regulating the foil angle or the pressure or the amount of the air blown from the foil and, when needed, a blowing can be provided at the end of the conveyor belt loop before a reversing roll for the purpose of separating the lead-in strip from the conveyor belt.

The friction surface in the arrangement in accordance with the invention is almost nonexistent, thereby allowing relatively small motors to be used. Owing to low friction, the wear of the conveyor belt is also minimal, which increases the service life of the conveyor belt.

The arrangement in accordance with the invention may be accomplished such that a number of devices in accordance with the invention are placed one after the other forming a conveyor with a module construction for long draws.

The arrangement in accordance with the invention is of light construction and easy to service.

The invention is suitable for several different places of application in a paper machine, for example, for a press section, a size press, a coater, for a transfer from a dryer section to a calender or for a transfer from a calender to a reel-up. The invention may also be used when the web is passed over open nips, for example, when using the on-line arrangement marketed under the current assignee's trademark OptiLoad, and for a transfer from a dryer section to a reel-up as well as in on-machine coating devices. As is clear from the examples listed above, the device in accordance with the invention is applicable to several different draws in open gaps of a paper machine.

The invention can be readily combined with various other threading devices, threading plates and threading blowings, etc. known in themselves.

In another embodiment of the device in accordance with invention, foil nozzles may also be arranged in the longitudinal direction of the device, in which connection a vacuum in the longitudinal direction can be produced.

In addition, the angle of the foil ribs in accordance with the invention with respect to the running direction of the web can be regulated from a cross direction to a longitudinal direction in order to achieve a desired effect and in order to affect the position of the lead-in strip on the conveyor wire in a lateral direction. The nozzles used may be slit or hole nozzles.

In the following, the invention will be described in more detail with reference to the figures in the accompanying drawing, to the details of which the invention is not by any means intended to be narrowly confined.

BRIEF DESCRIPTION OF THE DRAWINGS

Additional objects of the invention will be apparent from the following description of the preferred embodiment thereof taken in conjunction with the accompanying non-limiting drawings, in which:

FIGS. 3A and 3B are schematic illustrations of additional features of the device in accordance with the invention;

FIG. 4 is a schematic illustration of an additional application of the device in accordance with the invention;

DETAILED DESCRIPTION OF THE PREFERRED EMBODIMENTS

Figure 1A:
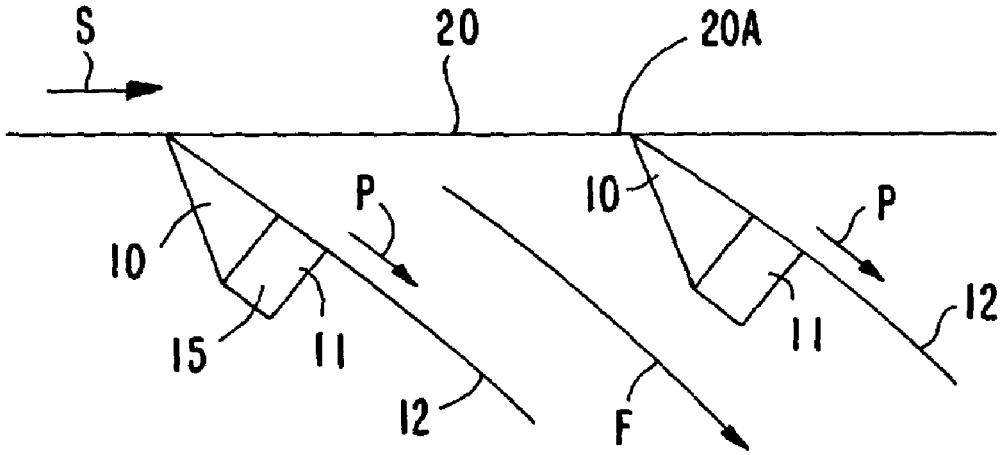
FIG. 1A is a schematic illustration of the basic principle of the device in accordance with the invention.

Referring to the drawings wherein corresponding reference numerals refer to the same or similar elements, FIG. 1 shows the basic principle of the device in accordance with the invention. Underneath a conveying run 20A of a conveyor belt, wire, band or equivalent 20, foil heads 10 are placed whose apex is in contact with or very close to the bottom face of the conveyor belt 20, and a vacuum is provided on the outlet face of the foil head. The running direction of the belt 20 is denoted with the arrow S in the figure. It is also possible to connect a blow nozzle 11 to the foil heads 10, from which nozzle a blowing P is blown in order to further intensify the effect of vacuum, and thus by the joint action of the foil head and the blowing an air flow F is produced which enhances the vacuum on the outlet side of the foil head. For the purpose of further enhancing the vacuum effect and the air flow, a curved air-flow guide face 12 may be placed after the blow nozzle 11, which guide face further enhances the vacuum effect and guides the air flow. In the figure, the whole of the foil head and the nozzle 11, i.e. a foil rib, is designated by the reference numeral 15. The nozzles 11 may be either slit or hole nozzles.

Figure 1B:
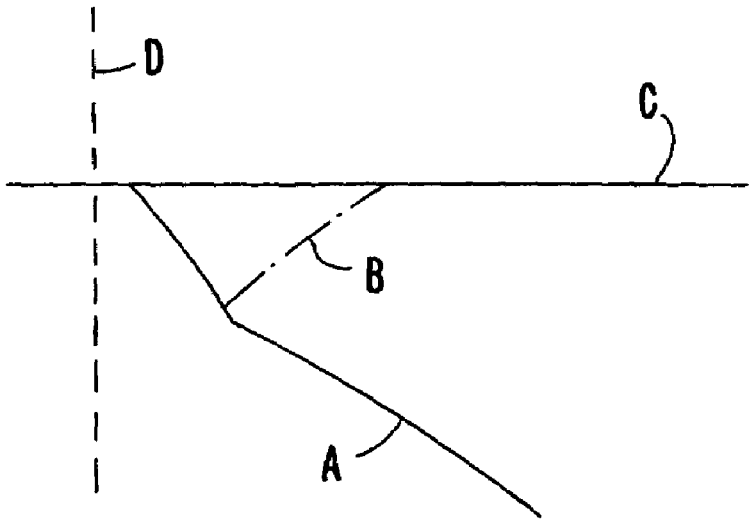
FIG. 1B is a schematic illustration of a vacuum level achieved by means of the arrangement in accordance with the invention as compared with a vacuum level achieved by means of an arrangement known from prior art.

FIG. 1B schematically shows the vacuum effect achieved by the foil rib/nozzle combination 15, the dashed line D denoting the point of the apex of the foil head 10 on the conveyor belt 20, and the curve A illustrating the vacuum to be achieved, and the line B of dots and dashes showing the vacuum effect achieved by means of arrangements known from prior art. The horizontal axis C represents the zero level of pressure.

Figure 2A:
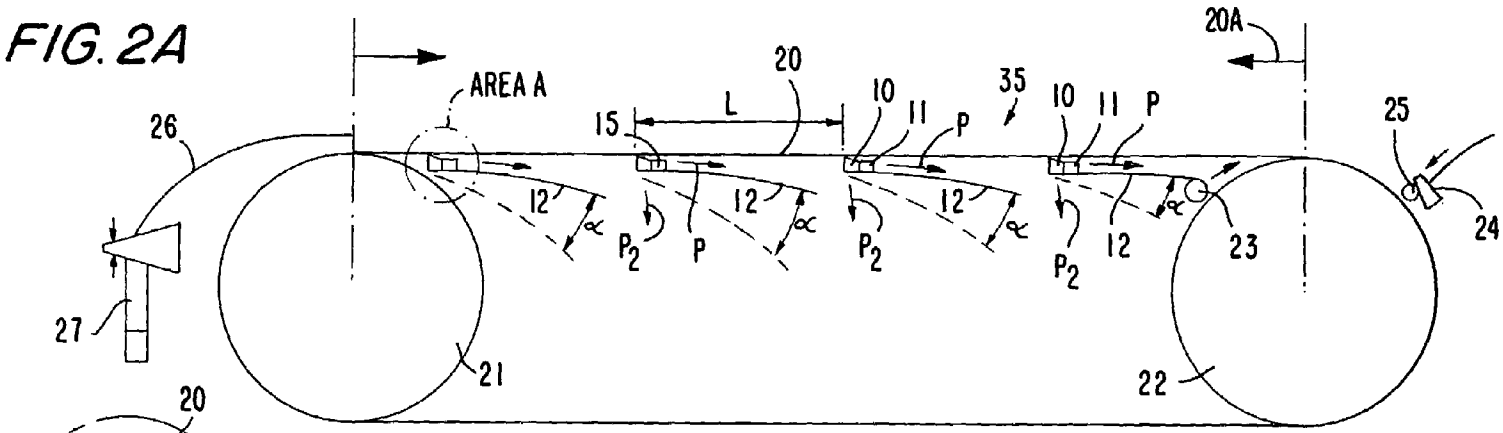
FIG. 2A is a schematic side view of one embodiment of the invention.
Figure 2B:
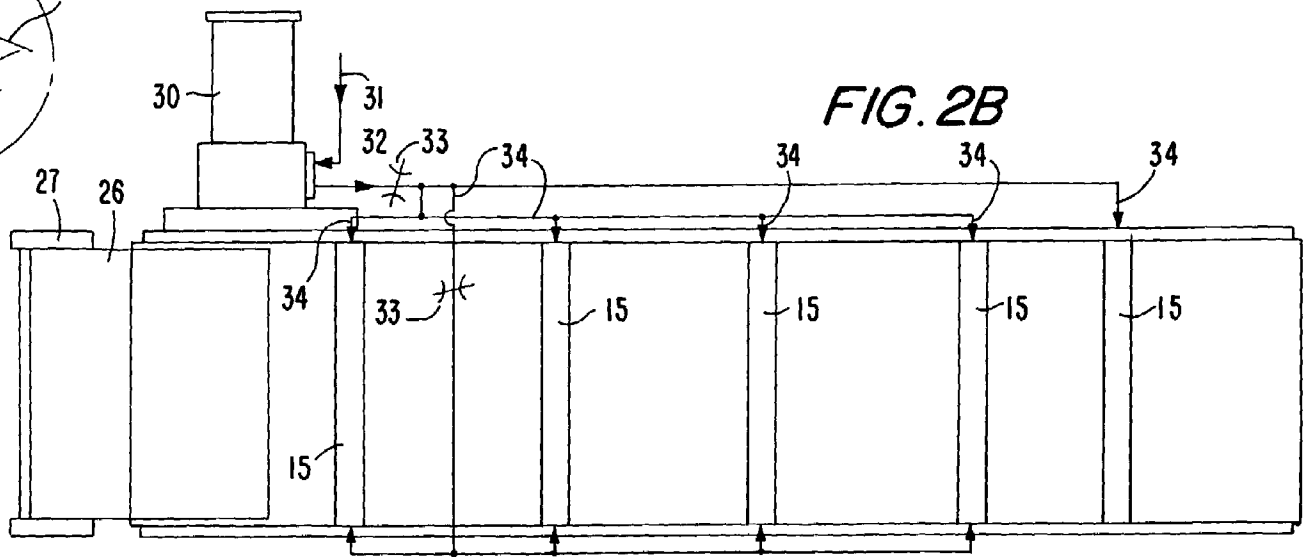
FIG. 2B is a schematic view of the embodiment shown in FIG. 2A as viewed from above.

FIGS. 2A and 2B show a device 35 in accordance with the invention comprising a conveyor belt loop 20 which is arranged to be rotating around at least two alignment reversing rolls or equivalent 21,22 as an endless closed loop. The conveyor belt 20 is permeable to air. Inside the conveyor belt loop 20, foil ribs 15 are placed which comprise a foil head 10 and a blow nozzle 11 to which a curved air-flow guide face 12 is also advantageously connected. The conveyor belt 20 is preferably rotated by means of a compressed-air motor 30, and air blown through the compressed-air motor is passed into the foil ribs 15 which are placed under the conveyor belt 20 and by means of which a vacuum can be produced under the conveyor belt 20. The angle of the foil can be regulated, whereby the level of vacuum can be regulated. If the necessary vacuum level is not achieved by regulating the angle, it is possible to utilize the Coanda effect which is provided from residual air of the compressed-air motor 30 or, when an electric motor is used, from a separate compressed air source by blowing air through the nozzle part 11 of the foil rib 15 along the face of the foil. Two blowings can be blown from the nozzle part 11 of the foil rib 15; one on the outlet side producing the Coanda effect, which blowing P preferably follows the curved guide face 12, and the other $P_2$ on the inlet side in order to enhance the air flow F produced by the preceding foil rib 15.

A feed 31 and a flow-through 32 of compressed air as well as by-pass regulating valves 33 are also shown in FIG. 2B. As the figure shows, the compressed-air motor comprises ducts 34 to the foil ribs 15.

Figure 2C:
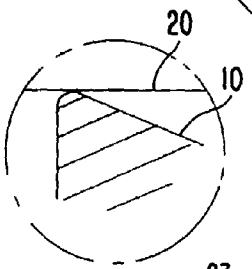
FIG. 2C is a schematic view of the area A in FIG. 2A.

FIG. 2C schematically shows a partial enlargement of the area A in FIG. 2A showing a suitable shaping of the foil head 10 for the purpose of providing a desired vacuum as one advantageous embodiment example.

In the embodiment example shown in FIG. 2A, a lead-in strip is passed from the preceding stage by means of a threading device 27, to which a guide plate 26 is attached, onto the conveyor 35 of the lead-in strip in accordance with the invention, from the conveyor belt 20 of which conveyor the lead-in strip is separated by a blowing which is produced by a blow nozzle 23, and passed further by means of a blowing produced by a blow device 25 onto a guide plate 24 of the lead-in strip.

The distance L between the foil ribs 15 used in the device 35 in accordance with the invention is about 30 to about 1000 mm, preferably about 50 to about 200 mm, the foil angle is below about 10°, preferably below about 3°, and the air permeability of the conveyor belt 20 is below about 10,000 $m^3/m^2*h$. The amounts of air used with a belt 20 of the width of 200 mm are about 50 to 300 l/min, typically less than 400 l/min, i.e. about 2,000 l/min/width meter, and pressures are used to pressures of up to about 2 bar. The regulation angle $\alpha$ of the foil is about 1 to about 10°, preferably 1 to 5°. The radius of curvature of the guide plates 12 is about 300 to about 1000 mm, preferably 400 to 600 mm.

In the embodiment example shown in FIGS. 3A and 3B, a nozzle 17 extending in the longitudinal direction of the conveyor belt 20 is attached to the device 35 in accordance with the invention, from which nozzle blowings P17 are blown, in which connection a longitudinal vacuum effect is achieved which can be enhanced by means of curved guide plates 18. As FIG. 3A shows, the foil ribs 15 can be turned from a cross direction to an oblique position and to a longitudinal position, i.e. as far as the running direction of the belt as desired in order to produce a vacuum effect of a desired type.

FIG. 4 shows that blowings $P_{20}$ can be directed from the foil rib 15 such that the lead-in strip can be displaced in a lateral direction on the belt 20.

Figure 5:
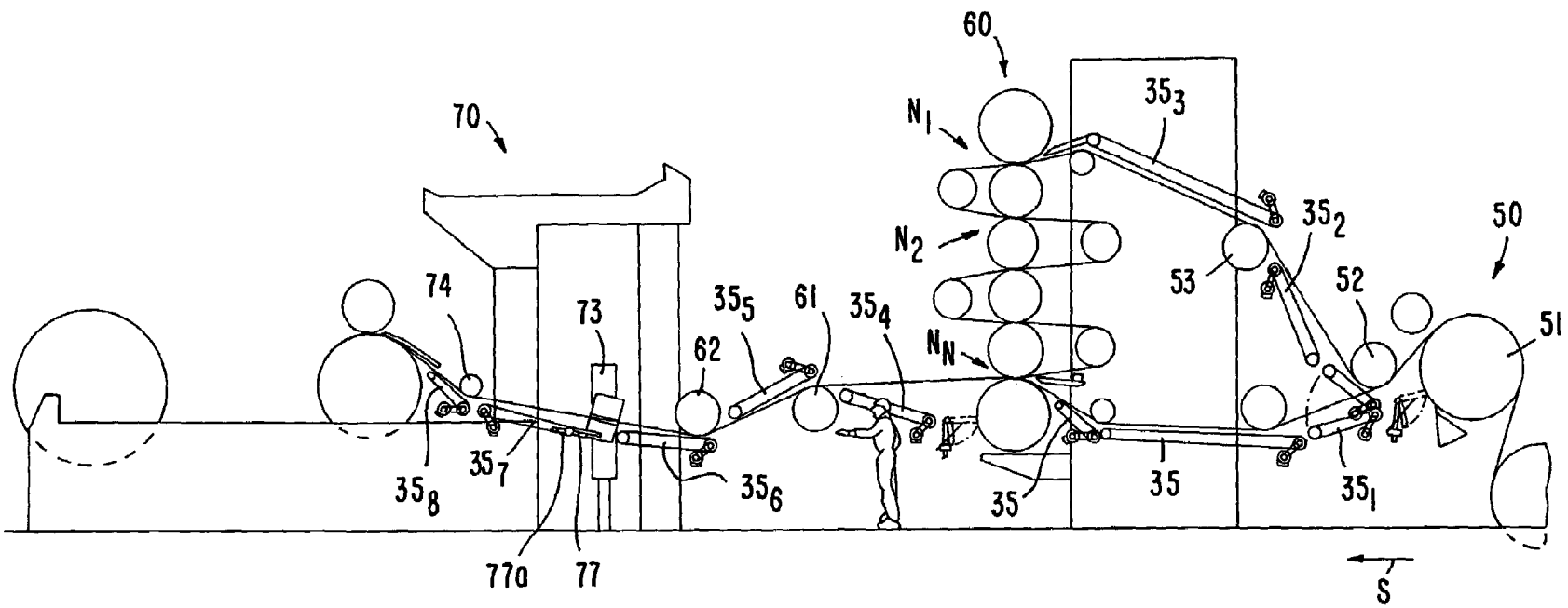
FIG. 5 is a schematic illustration of examples of uses of the device in accordance with the invention.
Figure 6:
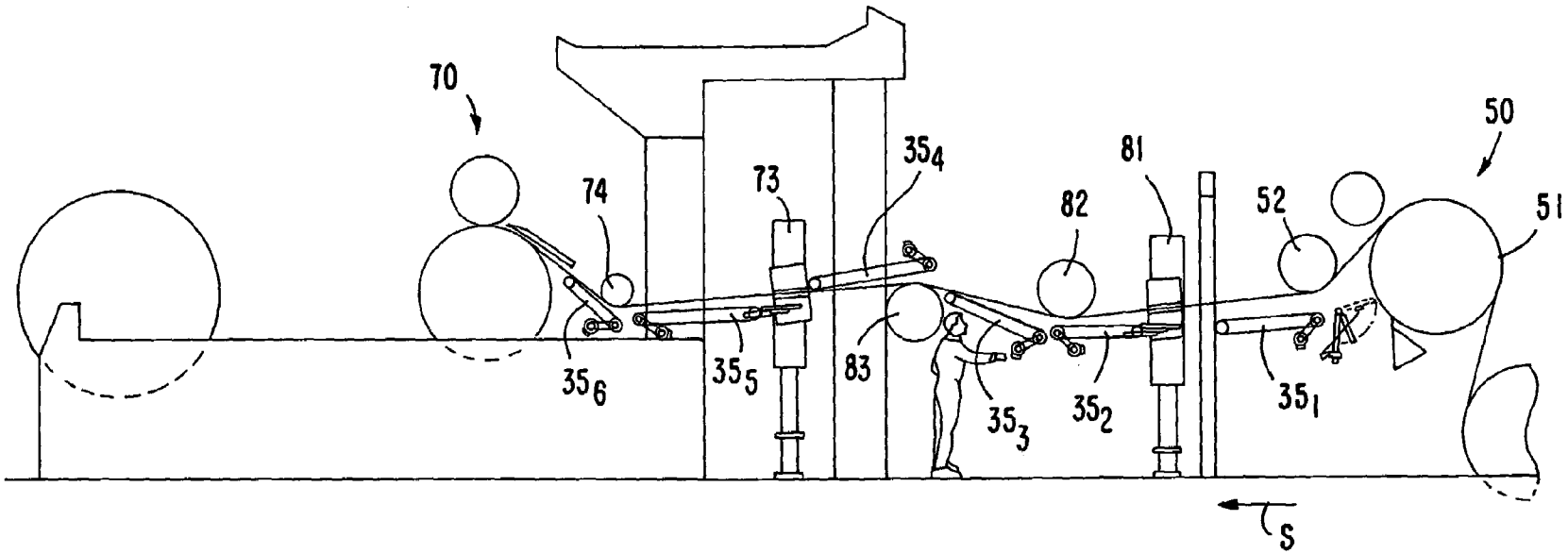
FIG. 6 is a schematic illustration of further examples of uses of the device in accordance with the invention.
Figure 7:
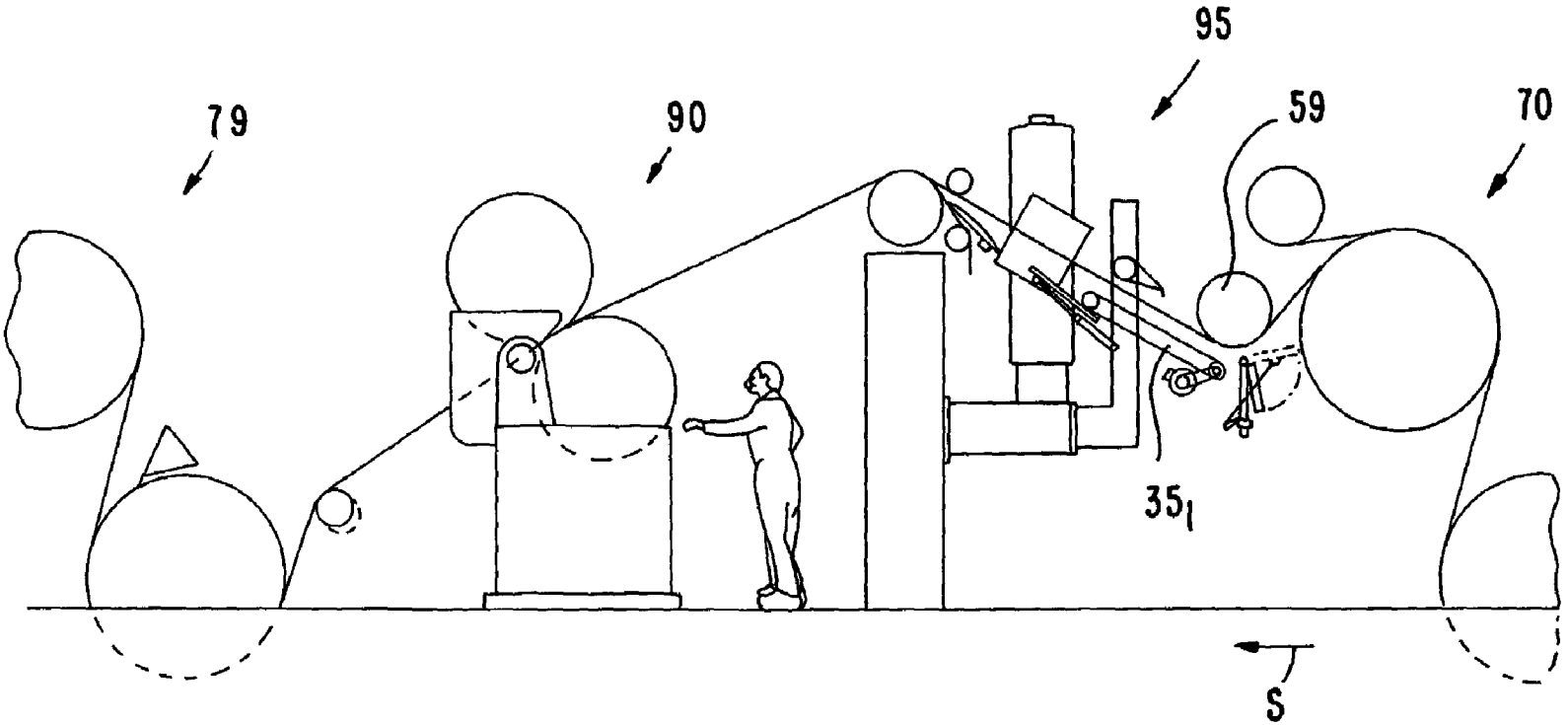
FIG. 7 is a schematic illustration showing another application of the invention.

FIGS. 5 to 7 schematically show some areas of application where the device 35 in accordance with the invention may be used in conveyance and guidance of a lead-in strip. The direction of running of the lead-in strip is designated by the reference numeral S and the same reference numerals are used of corresponding parts.

In FIG. 5, the lead-in strip is passed from the last drying cylinder 51 of a dryer section 50 to a calender 60 first over a guide roll 52 to a device $\mathbf{35}_1$ in accordance with the invention. The device $\mathbf{35}_1$ of the invention placed in connection with the guide roll 52 can be turned such that the lead-in strip can be arranged either to run through all calendering nips $N_1$–$N_N$ of the calender 60 or such that the lead-in strip passes only through the lowermost nip $N_N$ of the calender 60. When the lead-in strip is passed such that calendering is performed in all the nips $N_1$–$N_N$, the lead-in strip is passed by means of a second device $\mathbf{35}_2$ in accordance with the invention onto a guide roll 53, and therefrom further by means of a third device $\mathbf{35}_3$ in accordance with the invention into a first calendering nip $N_1$ of the calender 60. After that, the lead-in strip of the paper web is passed to a reel-up after the last nip $N_N$ of the calender, first using a device $\mathbf{35}_4$ in accordance with the invention onto a guide roll 61, therefrom via a device $\mathbf{35}_5$ in accordance with the invention onto the following guide roll 62 and further using a device $\mathbf{35}_6$ in accordance with the invention via a measurement device 73 and a guide roll 74 to the reel-up 70 by means of two devices $\mathbf{35}_7$, $\mathbf{35}_8$ of the invention placed underneath. A movable air blow plate 77 is placed after the measurement device 73 for conveying the lead-in strip, in connection with which plate a pneumatic cylinder 77*a* is provided for displacing the plate 77 in the machine direction. As the figure shows, the devices $\mathbf{35}_1$ to $\mathbf{35}_8$ in accordance with the invention can be placed above or under the lead-in strip and provided with movable air blow plates at scanners, through passages, etc.

FIG. 6 schematically shows an embodiment example in which a lead-in strip is passed from the last drying cylinder 51 of a dryer section 50 directly through measurement devices 81, 73 to a reel-up 70. As FIG. 6 shows, devices 35 in accordance with the invention are placed in all suitable open draws over which the lead-in strip is passed. The devices in accordance with the invention are numbered consecutively using a subscript $\mathbf{35}_1$ to $\mathbf{35}_6$. Guide rolls are designated by the reference numerals 52, 82, 83, 74.

FIG. 7 shows an embodiment example in which devices $\mathbf{35}_1$ in accordance with the invention are used in a draw between a dryer section 70 and a measurement frame 95.

The lead-in strip is passed to a size press 90 and to an after-dryer section 79 by rope threading.

Figure 8:
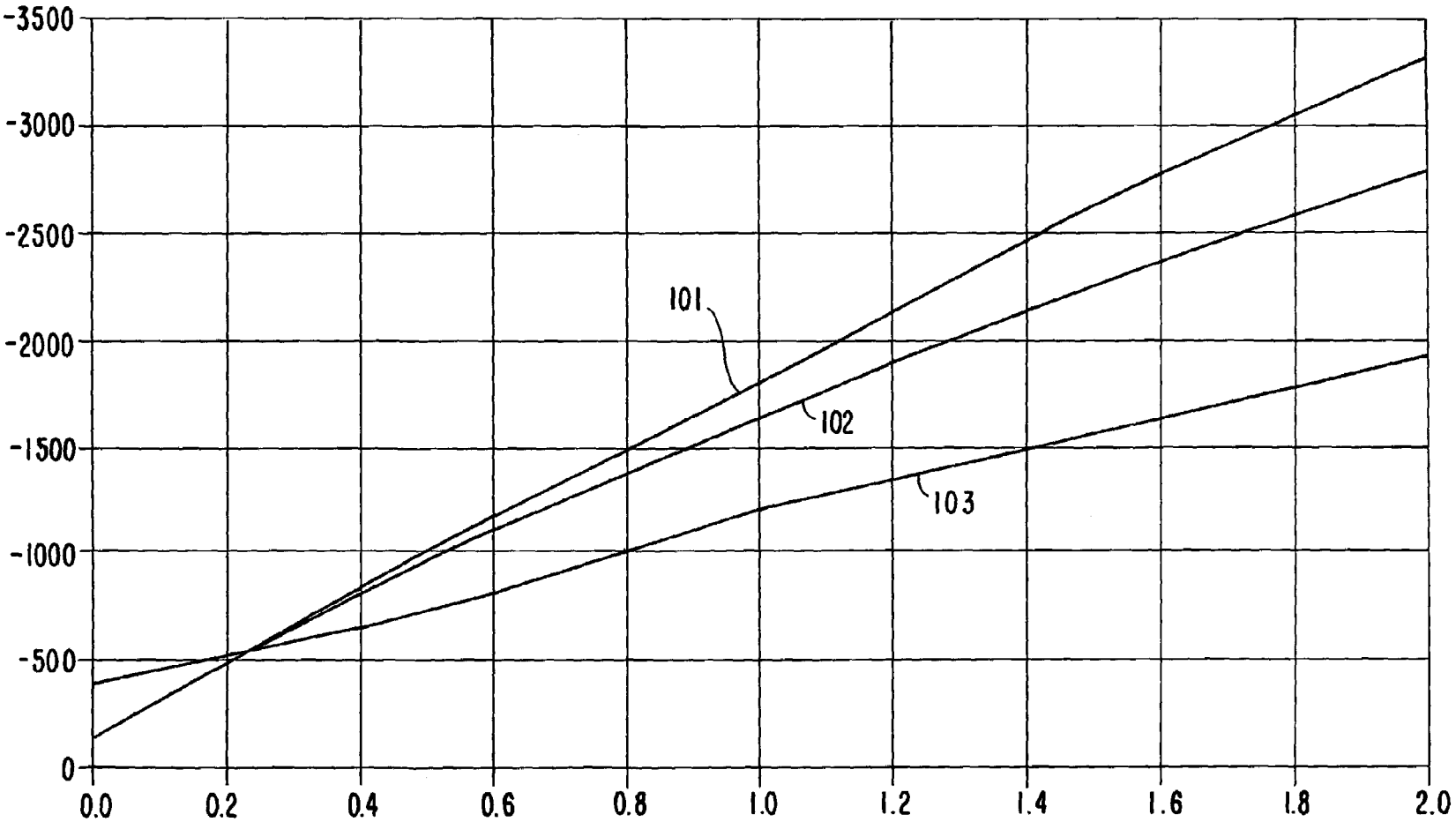
FIG. 8 is a schematic illustration of pressure compared with nozzle pressure at different foil angles.

FIG. 8 schematically shows pressures as compared with the nozzle pressure at different foil angle values. The vertical axis shows the pressure in pascal (Pa) and the horizontal axis shows the nozzle pressure in bar (bar). The curve 101 represents the situation when the foil angle is 0°+, the curve 102 represents the situation when the foil angle is 2°, and the curve 103 represents the situation when the foil angle is 4°. The air permeability of the conveyor belt in this test was 8,000 $m^3/m^2/h$ and the speed 1,800 m/min. The curves 101, 102, 103 intersect the nozzle pressure at a value of about 0.22 bar, after which the highest vacuums were achieved at a foil angle of 0°+. The expression 0°+ used above means that the angle is very close to zero, yet not negative.

Figure 9:
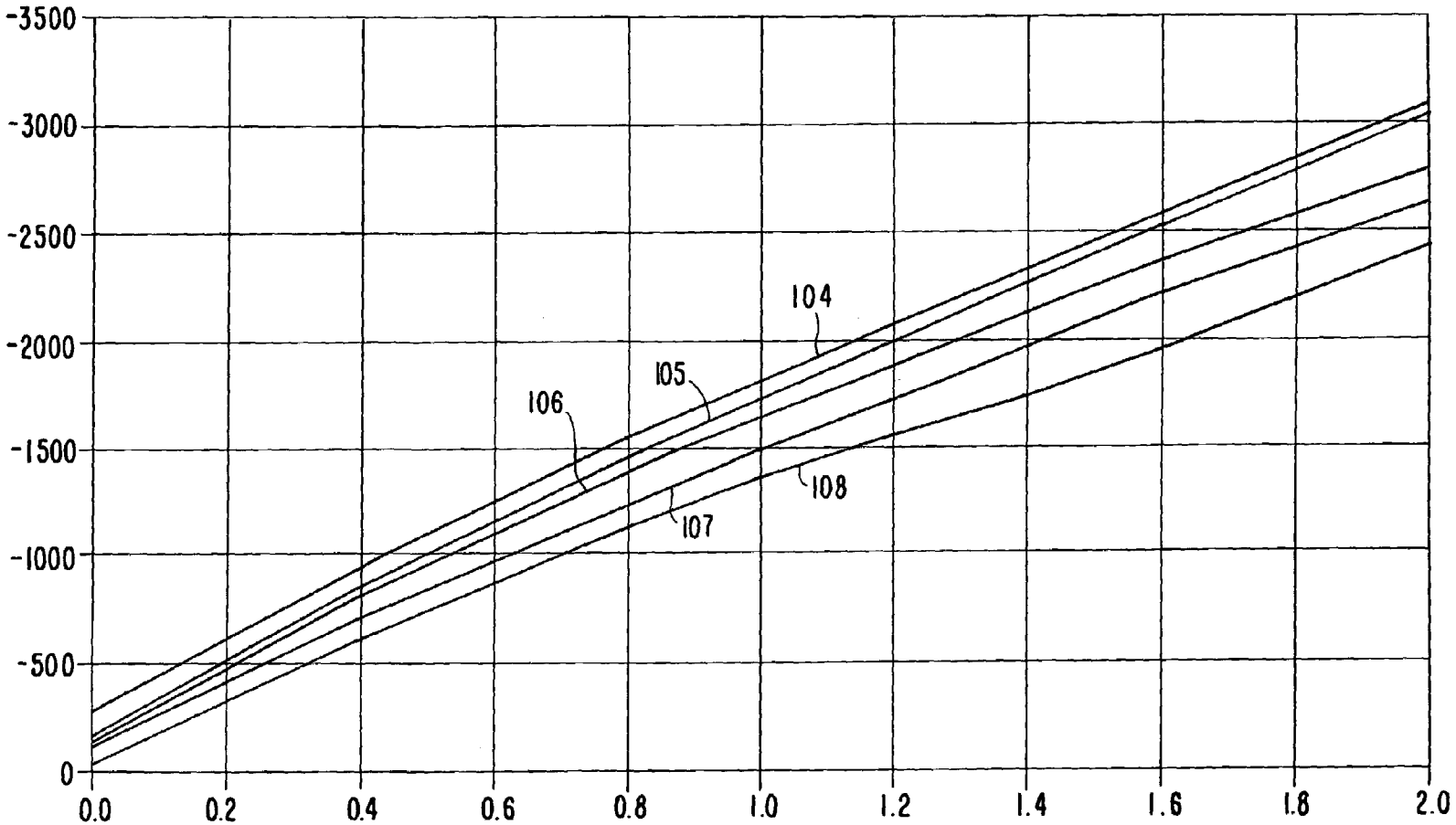
FIG. 9 is a schematic illustration of pressure compared with nozzle pressure at different speeds.

FIG. 9 shows pressures as compared with the nozzle pressure at different speeds when the air permeability of the conveyor belt is 8,000 $m^3/m^2/h$ and the foil angle 2°. The vertical axis shows the pressure in pascal (Pa) and the horizontal axis shows the nozzle pressure in bar (bar). The curve 104 represents the situation when the speed is 2,300 m/min, the curve 105 represents the situation when the speed is 2,000 m/min, the curve 106 represents the situation when the speed is 1,800 m/min, the curve 107 represents the situation when the speed is 1,500 m/min, and the curve 108 represents the situation when the speed is 1,000 m/min. As the curves of FIG. 9 show, increasing speed enhances the vacuum effect without the feed pressure of air being changed.

Figure 10:
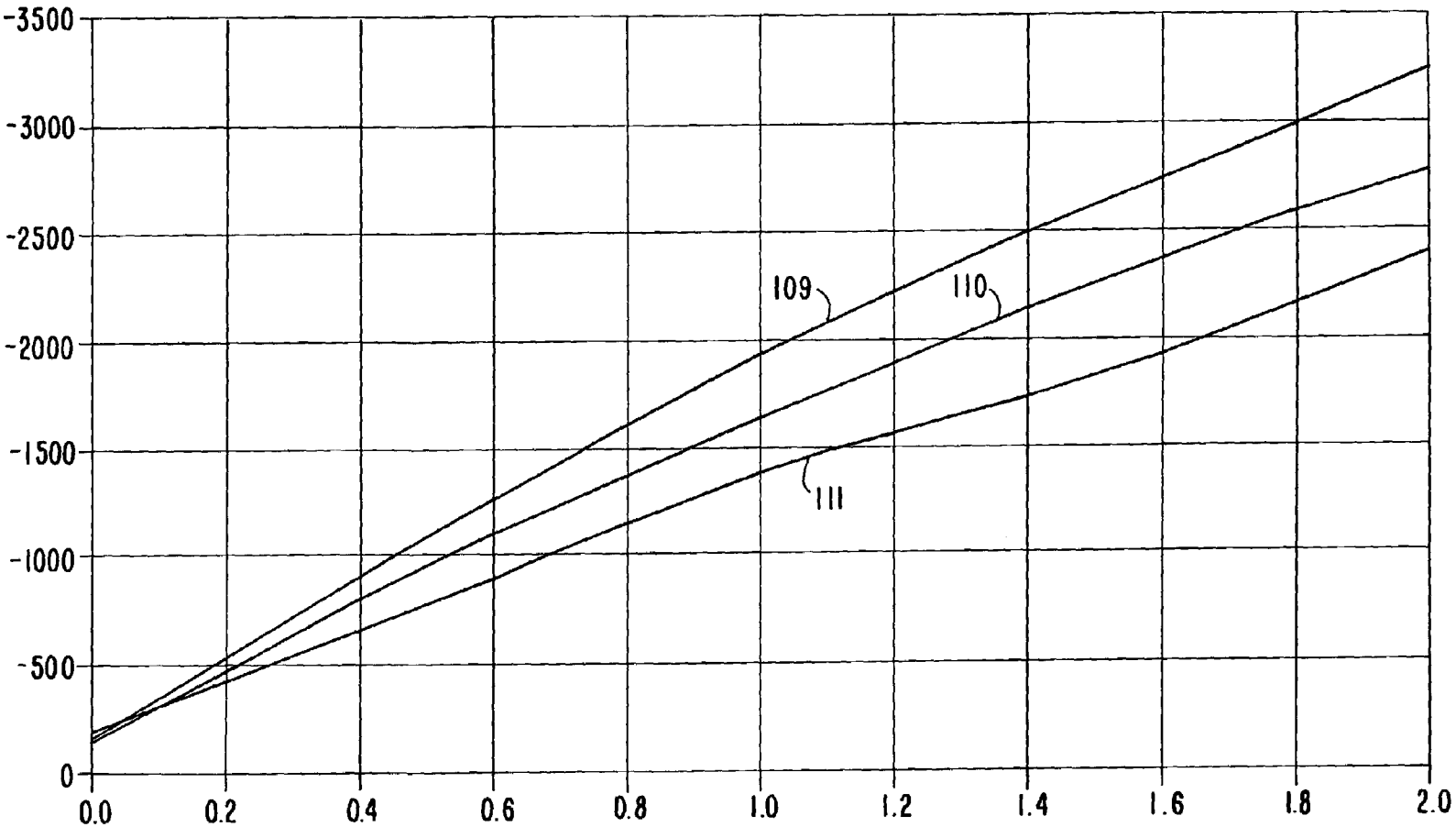
FIG. 10 is a schematic illustration of pressure compared with nozzle pressure when using fabrics having different permeability.

FIG. 10 shows pressures as compared with the nozzle pressure with different air permeability values of the conveyor belt, while the foil angle is 2° and the speed used is 1,800 m/min. The vertical axis shows the pressure in pascal (Pa) and the horizontal axis shows the nozzle pressure in bars. The curve 109 represents the situation with an air permeability of the conveyor belt of 10,000 $m^3/m^2/h$, the curve 110 with an air permeability of 8,000 $m^3/m^2/h$, and the curve 111 with an air permeability of 5,000 $m^3/m^2/h$. In other words, by increasing the air permeability of the conveyor belt, the vacuum effect can be enhanced.

Figure 11:
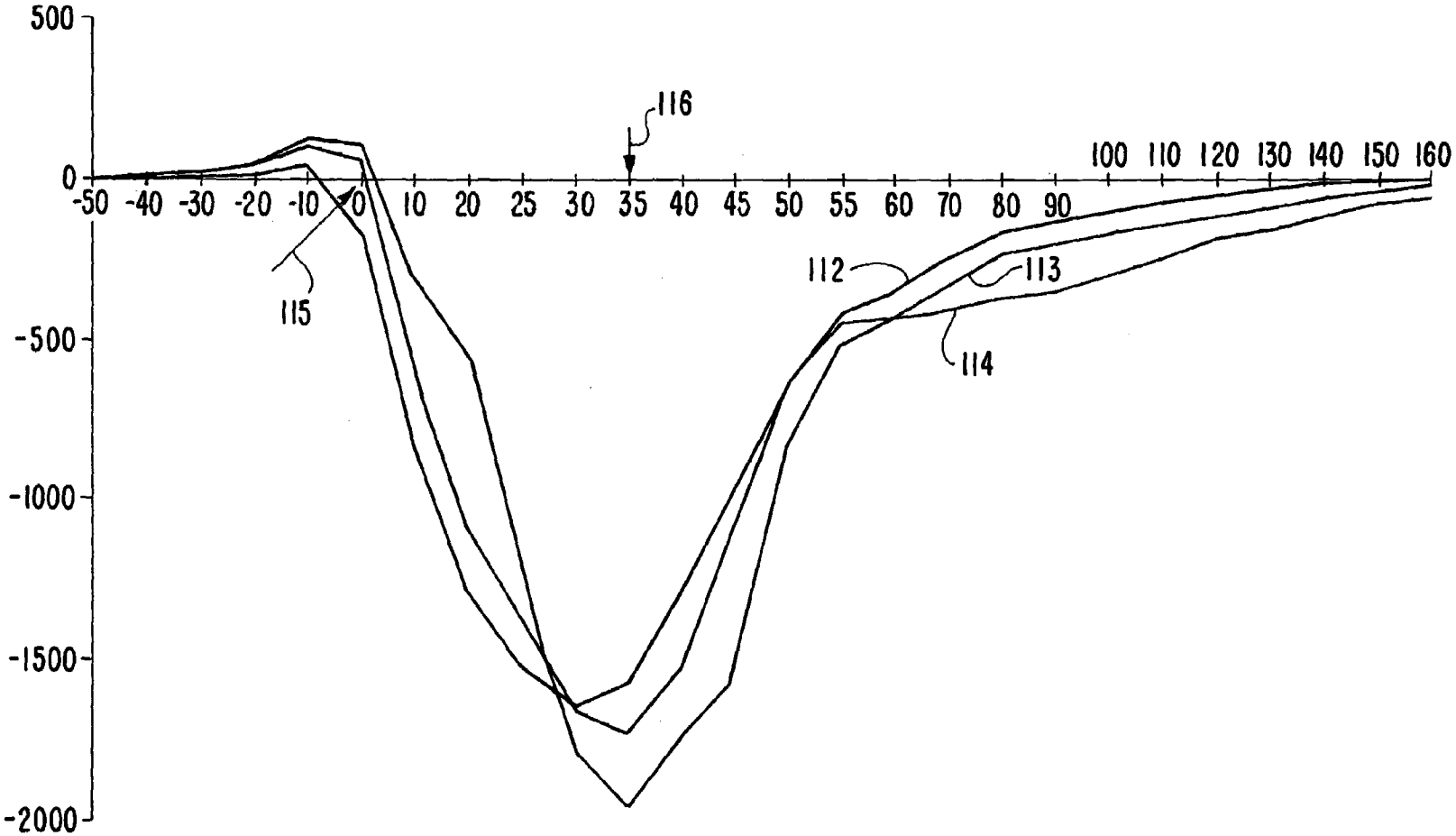
FIG. 11 illustrates pressure profiles across the foil with different permeability values of the conveying fabric.

FIG. 11 shows pressure profiles across the foil with different air permeability values of the conveyor belt. The test was carried out while the speed was 1,800 m/min, the foil angle was 2°, and the nozzle pressure was 1 bar. The curve 112 represents the situation with an air permeability value of 5,000 $m^3/m^2/h$, the curve 113 with an air permeability value of 8,000 $m^3/m^2/h$, and the curve 114 with an air permeability value of 10,000 $m^3/m^2/h$. The reference arrow 115 denotes the apex of the foil and the reference arrow 116 denotes the rear edge of the foil. During the test, the apex of the foil was in contact with the lower face of the conveyor belt. The vertical axis shows the pressure in pascal (Pa) and the horizontal axis shows the distance from the foil in millimeters (mm).

Figure 12:
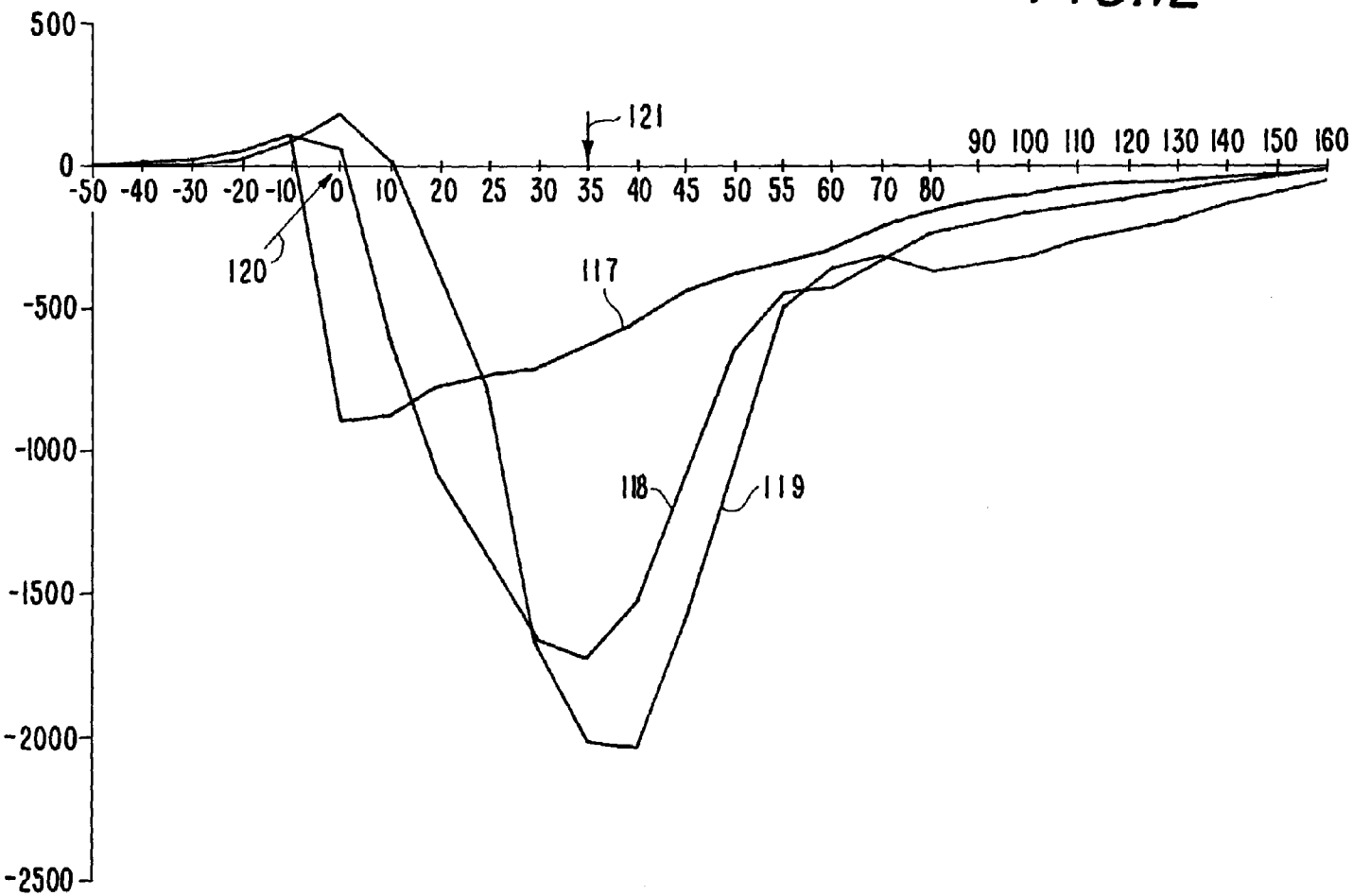
FIG. 12 illustrates pressure profiles with different values of the foil angle.

FIG. 12 shows pressure profiles at different foil angles. The curve 117 represents the situation when the foil angle is 4°, the curve 118 represents the situation when the foil angle is 2°, and the curve 119 represents the situation when the foil angle is 0°. The reference arrow 120 denotes the apex of the foil and the reference arrow 121 denotes the rear edge of the foil. The vertical axis shows the pressure in pascal (Pa) and the horizontal axis shows the distance from the foil in millimeters (mm).

It is seen from FIGS. 11 and 12 that by means of the arrangement in accordance with the invention, it is possible to create short machine-direction vacuum zones which can be regulated. The vacuum effect holding the belt is achieved immediately after the belt arrives at said vacuum zone.

Above, the invention has been described only with reference to some of its advantageous embodiment examples, to the details of which the invention is, however, not by any means intended to be narrowly confined. Many modifications and variations are feasible within the inventive idea defined in the following claims.

I claim:

1. A method for conveying and guiding a lead-in strip over a run of a conveyor in a paper machine, comprising the steps of:

directing a lead-in strip over a first face on a first side of a run of a conveyor; and producing a longitudinal vacuum effect across the run of the conveyor in the direction of movement of the run of the conveyor.

2. The method according to claim 1, wherein said vacuum effect is produced by a nozzle extending in a longitudinal direction relative to said run of said conveyor.

3. The method according to claim 2, wherein said nozzle produces a longitudinal vacuum transversely across said run of said conveyor.

4. The method according to claim 2, wherein said nozzle further comprising a curved guide face coupled to said nozzle for guiding an air flow produced by means of said nozzle to further enhance the vacuum effect.

5. The method according to claim 4, wherein said nozzle further comprising a curved guide face coupled to said nozzle for guiding an air flow produced by means of said nozzle to further enhance the vacuum effect by means of the Coanda effect.

* * * * *